US012054855B2

(12) United States Patent
Dressen et al.

(10) Patent No.: US 12,054,855 B2
(45) Date of Patent: Aug. 6, 2024

(54) METHOD FOR CLEANING AN AIR JET SPINNING DEVICE OF A SPINNING STATION, AN AIR JET SPINNING DEVICE OF THIS TYPE AND A THREAD-FORMING UNIT FOR AN AIR JET SPINNING DEVICE OF THIS TYPE

(71) Applicant: Saurer Intelligent Technology AG, Arbon Thurgau (CH)

(72) Inventors: Jochen Dressen, Schwalmtal (DE); Eduard Prediger, Mönchengladbach (DE)

(73) Assignee: Saurer Intelligent Technology AG, Arbon Thurgau (CH)

( * ) Notice: Subject to any disclaimer, the term of this patent is extended or adjusted under 35 U.S.C. 154(b) by 7 days.

(21) Appl. No.: 17/783,217

(22) PCT Filed: Dec. 8, 2020

(86) PCT No.: PCT/EP2020/085031
§ 371 (c)(1),
(2) Date: Jun. 7, 2022

(87) PCT Pub. No.: WO2021/116083
PCT Pub. Date: Jun. 17, 2021

(65) Prior Publication Data

US 2023/0016534 A1 Jan. 19, 2023

(30) Foreign Application Priority Data

Dec. 9, 2019 (EP) ..... 19214445

(51) Int. Cl.
*D01H 4/02* (2006.01)
*D01H 1/115* (2006.01)
*D01H 1/16* (2006.01)

(52) U.S. Cl.
CPC ..... *D01H 4/02* (2013.01); *D01H 1/115* (2013.01); *D01H 1/16* (2013.01)

(58) Field of Classification Search
CPC . D01H 1/115; D01H 1/16; D01H 4/02; D01H 13/26
See application file for complete search history.

(56) References Cited

U.S. PATENT DOCUMENTS 4,114,358 A * 9/1978 Tsuchida ..... D01H 15/00 57/328
4,819,419 A * 4/1989 Stahlecker ..... D01H 15/002 57/328

(Continued)

FOREIGN PATENT DOCUMENTS

CH 713499 A2 8/2018
CN 103014930 A 4/2013

(Continued)

OTHER PUBLICATIONS

Office Action from Chinese Patent Application No. 202080084674.8, issued Feb. 3, 2023, all enclosed pages cited (no English translation available).

(Continued)

*Primary Examiner* — Shaun R Hurley
(74) *Attorney, Agent, or Firm* — Nelson Mullins Riley & Scarborough LLP

(57) ABSTRACT

Method for cleaning an air jet spinning device of a spinning station, an air jet spinning device and a thread-forming unit for an air jet spinning device. The air jet spinning device has a thread-forming unit having a thread-forming element arranged in a vortex chamber of a nozzle unit, and a nozzle unit having at least one air nozzle orientated towards the vortex chamber such that an air flow exiting the air nozzle impinges on the sliver in the vortex chamber with a rotation flow. The thread-forming unit has an element carrier for (Continued)

detachably receiving and releasing the thread-forming element or, alternatively or in addition, can be linearly shifted in conjunction with the air jet spinning device relative to the nozzle unit between a closed operating position and an open cleaning position, and the air jet spinning device can be linearly shifted and/or pivoted in the cleaning position.

15 Claims, 6 Drawing Sheets

(56) References Cited

U.S. PATENT DOCUMENTS

| | | | | | |
|---|---|---|---|---|---|
| 5,172,542 | A * | 12/1992 | Stahlecker | D01H 1/115 57/328 |
| 5,511,373 | A * | 4/1996 | Banba | D01H 4/02 57/328 |
| 5,673,547 | A * | 10/1997 | Baba | D01H 4/02 57/328 |
| 5,809,764 | A * | 9/1998 | Baba | D01H 1/115 57/263 |
| 5,813,209 | A * | 9/1998 | Hirao | D01H 15/002 57/22 |
| 5,934,058 | A * | 8/1999 | Hirao | D01H 15/002 57/328 |
| 7,594,382 | B2 * | 9/2009 | Weide | D01H 4/02 57/22 |
| 2002/0033013 | A1 * | 3/2002 | Wassenhoven | D01H 1/16 57/406 |
| 2002/0124543 | A1 * | 9/2002 | Bischofberger | D01H 4/38 57/5 |
| 2006/0272132 | A1 * | 12/2006 | Stahlecker | D01H 5/56 19/236 |
| 2013/0333347 | A1 * | 12/2013 | Stephan | D01H 4/48 57/263 |
| 2019/0055679 | A1 * | 2/2019 | Xia | D02G 1/06 |

FOREIGN PATENT DOCUMENTS

| | | | | |
|---|---|---|---|---|
| CN | 105274666 | A | 1/2016 | |
| CN | 105803589 | A | 7/2016 | |
| DE | 2618094 | A1 | 11/1977 | |
| DE | 102004036955 | A1 * | 3/2006 | D01H 1/115 |
| EP | 0562230 | B1 | 5/1996 | |
| EP | 0854214 | A2 | 7/1998 | |
| EP | 1795633 | A2 * | 6/2007 | D01H 4/40 |
| EP | 2573220 | A2 | 3/2013 | |
| EP | 2329066 | B1 | 8/2014 | |
| EP | 2620532 | B1 | 12/2015 | |
| EP | 2949793 | A2 | 12/2015 | |
| EP | 3048191 | A1 | 7/2016 | |
| JP | H07216670 | A | 8/1995 | |
| JP | 2013067895 | A | 4/2013 | |
| JP | 2019044306 | A | 3/2019 | |
| WO | WO-2004048656 | A1 * | 6/2004 | D01H 1/115 |
| WO | 2006063482 | A1 | 6/2006 | |
| WO | 2018228864 | A1 | 12/2018 | |
| WO | 2021116083 | A1 | 6/2021 | |

OTHER PUBLICATIONS

International Search Report of PCT/EP2020/085031, dated Feb. 12, 2021, all enclosed pages cited.

"Spinning With an Air Jet" Textile World, Mar. 19, 2012, retrieved Sep. 9, 2022: https://www.textileworld.com/textile-world/features/2012/03/spinning-with-an-air-jet/.

M.R.Mahmoudi, Self-twist spinning, Agents and Chemotherapy, Advances in Yarn Spinning Technology, 2010, Abstract. <https://www.sciencedirect.com/science/article/pii/B9781845694449500140>.

Office Action from Pakistan Patent Application No. 821/2020, dated Jun. 25, 2021.

European Search Report for European Patent Application No. 19214445.9, dated Jun. 8, 2020, all enclosed pages cited.

Office Action from Bangladesh Patent Application No. 309/2020/238, filed Nov. 1, 2020, dated Jan. 23, 2022, all enclosed pages.

Written Opinion for European Patent Application No. 19214445.9, dated Feb. 9, 2023, all enclosed pages cited.

Office Action from Japanese Patent Applicaation No. 2022-534749, issued May 13, 2024, all enclosed pages cited (no English translation available).

* cited by examiner

METHOD FOR CLEANING AN AIR JET SPINNING DEVICE OF A SPINNING STATION, AN AIR JET SPINNING DEVICE OF THIS TYPE AND A THREAD-FORMING UNIT FOR AN AIR JET SPINNING DEVICE OF THIS TYPE

CROSS-REFERENCE TO RELATED APPLICATIONS

This application is a 35 U.S.C. 371 national stage filing of International Application PCT/EP2020/085031, filed Dec. 8, 2020, which claims priority from EP National Patent Application No. 19214445.9, filed Dec. 9, 2019, entitled "Verfahren zur Reinigung einer Luftspinnvorrichtung einer Spinnstelle, eine solche Luftspinnvorrichtung and eine Fadenbildungseinheit für eine solche Luftspinnvorrichtung", the entire contents of which are incorporated herein by reference.

FIELD OF THE INVENTION

The present invention concerns a method for cleaning an air jet spinning device of a spinning station, as well as such an air jet spinning device for manufacturing an air-spun thread from a supplied sliver, comprising a thread-forming unit, which has a thread-forming element which can be or is arranged in a vortex chamber of a nozzle unit, and the nozzle unit, which has at least one air nozzle oriented toward the vortex chamber in such a way that an air flow emerging from the air nozzle applies a rotational flow to the sliver, which can be or is fed into the vortex chamber.

The present invention further relates to a thread-forming unit for such an air jet spinning device.

BACKGROUND OF THE INVENTION

Spinning stations as well as air-spinning machines composed of a plurality of spinning stations arranged side by side are known from the prior art in a variety of embodiments. Apart from rotor spinning machines, air-spinning machines are the most frequently used machines for manufacturing a thread from a fibre material.

In air spinning, a sliver is typically drafted by means of a drafting system according to the thread fineness to be achieved and is then fed to an air jet spinning device. Inside the air jet spinning device, the outer fibres of the fibre band are wound around the inner core fibres of the sliver by means of a rotational flow generated by one or more air nozzles and thus form the wrap fibres, which are decisive for the desired thread strength of the thread. This results in a thread, which can finally be taken up through an outlet opening of the air jet spinning device and, for example, wound on a tube.

Due to the process, blockages or contamination of the air jet spinning device, e.g. of the air nozzles or an area immediately upstream of the air nozzles, can occur at irregular intervals during the spinning procedure. The blockages or the contamination results primarily from loose fibre material of the sliver, which loose fibre material accumulates upstream of the air nozzles and causes the surrounding fibres to no longer be wound around the core fibres in the specified manner. Due to the importance of the wrap fibres for the thread strength, this has the consequence that the thread exiting the air jet spinning device no longer has the required thread strength.

For simple fault elimination, it has already been disclosed in European Patent Publication EP 3 048 191 A1 that the air jet spinning device can be opened for cleaning, in which case the thread-forming unit, with its thread-forming element, e.g. a spinning cone, arranged in the vortex chamber of the nozzle unit, is repositioned relative to the nozzle unit, thereby rendering the interior of the air jet spinning device accessible for the operating personnel in order to be cleaned.

SUMMARY OF THE INVENTION

The problem addressed by the present invention is one of providing a method for cleaning an air jet spinning device of a spinning station as well as an air jet spinning device and a thread-forming unit for such an air jet spinning device which enable particularly simple and effective cleaning of the air jet spinning device.

The present invention solves the problem by means of an air jet spinning device for manufacturing an air-spun thread from a supplied sliver, comprising: a thread-forming unit (3), which has a thread-forming element (5) which can be or is arranged in a vortex chamber (4) of a nozzle unit (6), and the nozzle unit (6), which has at least one air nozzle oriented toward the vortex chamber (4) in such a way that an air flow emerging from the air nozzle applies a rotational flow to the sliver (39), which can be or is fed into the vortex chamber (4), characterised in that the thread-forming unit (3) is mounted so as to be linearly displaceable relative to the nozzle unit (6) between a closed operating position and an open cleaning position of the air jet spinning device (2), and the air jet spinning device (2) is designed so as to be linearly displaceable and/or pivotable in the cleaning position.

The present invention solves the problem by means of a method for cleaning an air jet spinning device (2), characterised in that the thread-forming unit (3) is linearly displaced relative to the nozzle unit (6) in order to reposition the air jet spinning device (2) from the closed operating position to the open cleaning position, and the opened air jet spinning device (2) is then linearly displaced and/or pivoted, in particular relative to an associated drafting system (1).

The present invention solves the problem by means of a thread-forming unit (3) for an air jet spinning device, characterised by an element carrier (19), which is designed to releasably hold a thread-forming element (5) designed for arrangement in a vortex chamber (4) of a nozzle unit (6), which nozzle unit (6) can work in conjunction with the thread-forming unit (3).

Advantageous further developments of the spinning station and of the method are stated in the dependent claims.

The air jet spinning device according to the present invention is characterised in that the thread-forming unit is mounted so as to be linearly displaceable relative to the nozzle unit between a closed operating position and an open cleaning position of the air jet spinning device and in that the air jet spinning device, i.e. the thread-forming unit together with the nozzle unit, is designed so as to be linearly displaceable and/or pivotable in the cleaning position.

An essential feature of the air jet spinning device is that it has at least two structural units which can be repositioned relative to one another and thus enable the air jet spinning device to be opened, thus making it possible to clean the interior. The structural units are, firstly, the nozzle unit and, secondly, the thread-forming unit. The nozzle unit has at least one air nozzle directed towards a vortex chamber, the outgoing air flow of which air nozzle acts on the sliver, which can be or is arranged in the nozzle unit, in such a way that the sliver is subjected to a rotational flow, by means of which the outer fibres of the sliver are wound around the core fibres. The thread-forming unit has a thread-forming element, for example a spinning cone. In the operating position, the thread-forming unit is located in a position relative to the nozzle unit in which the thread-forming element is arranged within the vortex chamber of the nozzle unit. The thread formed in the air jet spinning device due to the rotational flow generated by one or more air nozzles is conducted away via the thread-forming element, in particular via a thread take-up duct configured with the thread-forming element, for example by passing the thread through a central opening of a hollow spinning cone and taking up the thread from the spinning device at the outlet opening of the thread-forming element.

According to the present invention, the thread-forming unit with the thread-forming element is mounted so as to be linearly displaceable relative to the nozzle unit between the closed operating position and an open cleaning position of the air jet spinning device, the thread-forming element, e.g. the spinning cone, being guided out of the vortex chamber. According to the present invention, there is provision that, following the opening movement, namely in the cleaning position of the air jet spinning device, the latter is linearly displaceable and/or pivotable, i.e. the nozzle unit and the thread-forming unit are displaced and/or pivoted jointly in the open cleaning position.

This embodiment of the present invention allows particularly easy and convenient access to the interior of the air jet spinning device, which can then be cleaned quickly and easily, for example in an automated manner or by the operating personnel. Movement of the opened air jet spinning device offers the possibility, in a special way, for the opened air jet spinning device to be repositioned into an easily accessible position, so that contamination can be removed and taken away from the spinning station in a particularly simple and reliable manner. The ability to displace and/or pivot the opened air jet spinning device basically enables an optimum arrangement for manual or automated cleaning of the air jet spinning device and, if necessary, also of the upstream drafting system.

The design of the ability to displace and/or pivot the air jet spinning device in the open cleaning position is basically freely selectable. For example, it is possible to support the air jet spinning device in a suitable manner on the spinning station, e.g. on a spinning station frame, by means of suitable supporting elements. According to a particularly advantageous embodiment of the present invention, however, there is provision for the air jet spinning device to be rotatably and/or pivotably supported on a drafting system associated with the air jet spinning device and for the air jet spinning device to be linearly displaceable and/or pivotable relative to the drafting system, for the purpose of the relative displacement and/or pivoting ability in the cleaning position.

A corresponding embodiment of the present invention makes it possible to align the air jet spinning device directly with the upstream drafting system feeding the sliver. After cleaning of the air jet spinning device and a subsequent transfer of the air jet spinning device to the operating position, it is thus ensured in a particularly reliable manner that the air jet spinning device is aligned in a position relative to the drafting system which is optimal for the spinning process. In addition, the arrangement on the drafting system allows for simple, displaceable and/or pivotable support on the drafting system, so that alternative supporting means can be dispensed with at the spinning station.

The linear displacement and/or pivoting function of the opened air jet spinning device in the cleaning position, relative to the drafting system, can, for example, be carried out manually by the operating personnel, who move the opened air jet spinning device according to the provided repositioning ability and then carry out the necessary cleaning measures on the air jet spinning device.

However, according to a particularly advantageous embodiment of the present invention, a drive unit is provided for the automated displacement and/or pivoting of the air jet spinning device in the cleaning position. Automated movement of the opened air jet spinning device especially ensures reliable arrangement of the air jet spinning device in a position that is optimal for cleaning. Operating errors by the operating personnel can be avoided in a particular manner by means of an automated drive unit. The embodiment of the drive unit is basically freely selectable, and pneumatically acting drive units can also be used, for which the compressed air normally present at the spinning stations can be employed, so that no additional drive means are required. Alternatively, however, it is also possible to use electric-motor or pneumatic drive units.

The longitudinal displacement of the thread-forming unit relative to the nozzle unit for moving the air jet spinning device from the operating position to the cleaning position can basically be carried out in any desired manner. According to a particularly advantageous embodiment of the present invention, however, there is provision for the thread-forming unit to be linearly displaceable relative to the nozzle unit in the longitudinal axis direction of the thread-forming element, i.e. in the longitudinal extension direction of the thread-forming element, which corresponds to a take-up direction of the thread through a take-up duct formed within the thread-forming element. A correspondingly oriented opening movement is characterised in that the thread-forming element, e.g. the spinning cone, is disengaged from the nozzle unit in a particularly reliable manner and in that after just a relatively short opening movement, good accessibility to the interior of the air jet spinning device is provided, which enables reliable cleaning. The movement in this case is preferably in the drafting plane and running direction of the sliver, so that no lateral movement spaces are required at the spinning station for the movement of the air jet spinning device from the operating position to the cleaning position.

According to a further embodiment of the present invention, there is further provision for the thread-forming unit to be mounted on a guide element having a guide section, so as to be linearly displaceable relative to the nozzle unit. The use of one or more guide elements ensures in a particular manner the repositioning movements of the air jet spinning device between the operating position and the cleaning position. The guide element ensures in a particularly reliable manner that, after a return movement from the rest position to the operating position, the thread-forming unit and the nozzle unit are arranged relative to one another in such a way that the spinning process can be started within the air jet spinning device without problems. In a particularly reliable manner, the guide element prevents lateral movements, which could lead to a problem.

As already with the displacement and/or pivoting of the air jet spinning device in the cleaning position, movement of the air jet spinning device between the operating position and the cleaning position can also be carried out manually by the operating personnel. However, according to a particularly advantageous embodiment of the present invention, a drive unit, in particular a pneumatically acting drive unit, is provided for repositioning the air jet spinning device between the operating position and the cleaning position.

The use of a drive unit ensures reliable repositioning of the air jet spinning device from the operating position into the cleaning position as well as, in particular, a return movement to the operating position, so that it is ensured in a particularly reliable manner that the spinning process runs without problems after a return movement to the operating position and the resumption of the spinning process. The use of a pneumatically acting drive unit is characterised in that, for this purpose, the compressed air usually already available at spinning stations can be used to operate the drive unit, so that no additional supply lines are required for operating the drive unit.

The arrangement of the thread-forming element, e.g. a spinning cone, on the thread-forming unit is basically freely selectable. For example, the thread-forming element can be formed integrally with a housing of the thread-forming unit, in which case, in order to move the air jet spinning device from the operating position into the cleaning position, the housing can then be repositioned together with the thread-forming element relative to the nozzle unit. According to a preferred embodiment of the present invention, there is provision for the thread-forming unit to have an element carrier, which is designed to releasably hold the thread-forming element in the cleaning position of the air jet spinning device.

According to this embodiment of the present invention, the element carrier of the thread-forming unit is used for the simple, releasable and thus exchangeable holding of the thread-forming element, the exchangeability being given in the cleaning position of the air jet spinning device. The use of the element carrier is thus characterised in that it allows the thread-forming element to be exchanged easily if necessary, thus considerably reducing any downtime at the spinning station and allowing contamination and blockages to be eliminated by exchange of the thread-forming element without taking up any significant amount of time. The element carrier also offers the possibility of operating the thread-forming unit with different thread-forming elements, in which case a change can be made with only little effort.

The thread-forming element can be releasably arranged on the advantageously provided element carrier basically in any manner. It must be ensured that the thread-forming element can be fixed in a stationary position on the thread-forming unit. According to a particularly preferred embodiment of the present invention, there is provision here for the element carrier to have mounting openings which are designed for the bayonet-type locking of the thread-forming element and/or the locking of the thread-forming element by means of fastening clips.

According to this embodiment of the present invention, mounting openings are arranged on the element carrier, which mounting openings can be brought into engagement with corresponding counter elements on the exchangeable thread-forming element and enable locking on the element carrier. If the mounting opening is designed for a bayonet-type arrangement of the thread-forming element, the mounting opening has an undercut, which can be brought into engagement, for example, with a stud on the thread-forming element and enables positive locking of the thread-forming element. Alternatively or in addition, the mounting openings can also be designed to accommodate fastening clips, by means of which the thread-forming element can be arranged in a fixed position on the element carrier. To fix the thread-forming element in place, the element carrier can also have detent bodies which, in the operating position of the thread-forming element on the element carrier, engage with corresponding detent marks on the thread-forming element.

According to a particularly advantageous embodiment of the present invention, there is furthermore provision for the element carrier to be designed for lateral removal of the thread-forming element parallel to the drafting plane of the sliver or obliquely to the thread forming direction of the thread-forming element. According to this embodiment of the present invention, the element carrier, for example with its advantageously provided mounting openings, is designed in such a way that the direction of movement of the thread-forming element during removal from or insertion into the element carrier is lateral and parallel to the drafting plane or oblique to the thread forming direction of the thread-forming element, in particular oblique to a thread take-up guiding direction of the thread-forming element. This embodiment of the present invention ensures a simple and convenient change of the thread-forming element when necessary, since in the corresponding area of the spinning station there is good accessibility for the operating personnel or suitable automatic devices. Any necessary exchange procedures can thus be carried out in a particularly simple and convenient manner.

Cleaning of the air jet spinning device in its cleaning position can basically be carried out in an automated manner or by the operating personnel using suitable aids. In order to prevent a frequently recurring problem, it is advantageous to remove existing contamination from the air jet spinning device in such a way that the contamination is completely removed from the spinning station and thus does not lead to renewed contamination, including at adjacent spinning stations. It is conceivable, for example, to use suitable extraction systems for this purpose, which are automated or operated and used by the operating personnel.

According to an advantageous embodiment of the present invention, there is provision for an extraction device to be arranged below the drafting plane of the sliver in an entry region of the nozzle unit, which extraction device, according to a preferred embodiment of the present invention, is arranged stationary at the air jet spinning device. The extraction device is located in an area below the nozzle unit, in which nozzle unit the drafted sliver is fed into the air jet spinning device. A corresponding arrangement ensures that loose fibre material is transported out effectively, which loose fibre material tends to accumulate in the area around the entry region of the nozzle unit, where it leads to contamination or blockages that interfere with operation. Arrangement below the drafting plane ensures in a particularly reliable manner that loose fibre material enters the extraction device.

Extraction can be performed even during the normal spinning process as well as during the opening of the air jet spinning device. In addition it is possible, by moving the air jet spinning device into its cleaning position, to position the extraction device in such a way that the area of the drafting system around the output roller pair, in particular the output bottom roller, is also freed from contamination by means of the extraction device. Thus, the displacement and/or pivoting of the air jet spinning device in the cleaning position allows cleaning of sections of the associated drafting system to be additionally achieved.

The present invention further solves the problem by means of a method for cleaning an air jet spinning device, an air jet spinning device according to the present invention as presented above or an air jet spinning device that has been developed further, in which method the thread-forming unit is linearly displaced relative to the nozzle unit in order to reposition the air jet spinning device from the closed operating position to the open cleaning position, and the opened air jet spinning device is then linearly displaced and/or pivoted, in particular relative to an associated drafting system.

The repositioning of the air jet spinning device in accordance with the method according to the present invention guarantees a particularly reliable and comprehensive cleaning of the air jet spinning device so that a trouble-free spinning operation can be resumed afterwards. The method according to the present invention provides that, after an initial opening of the air jet spinning device, i.e. a movement of the thread-forming unit relative to the nozzle unit into the cleaning position, the air jet spinning device arranged in the cleaning position is subsequently displaced and/or pivoted, in particular relative to the associated drafting system, resulting in good accessibility for automated cleaning and/or for the operating personnel for cleaning.

According to a particularly advantageous further development of the method according to the present invention, the air jet spinning device is linearly displaced and/or pivoted, in the cleaning position, relative to the associated drafting system in such a way that an extraction device arranged below the drafting plane in an entry region of the nozzle unit enters an operative connection with an output bottom roller of an output roller pair of the drafting system.

According to this embodiment of the present invention, a movement of the opened air jet spinning device has the result that an advantageously provided extraction device on the air jet spinning device is arranged opposite the output roller pair in such a way that deposits and contamination, e.g. loose fibre material, located there are removed from the output bottom roller by the extraction device. The preferably provided arrangement can be achieved in particular in that the extraction device is mounted and/or designed so that it can be brought closer to the output roller pair in the course of the movement of the air jet spinning device, or in that the distance between the output roller pair and the extraction device is reduced in the course of the movement of the air jet spinning device. This further development of the method according to the present invention thus increases the cleaning effect in a supplementary manner.

BRIEF DESCRIPTION OF THE DRAWINGS

An embodiment example of the present invention is explained below with reference to the drawings. In the drawings.

DESCRIPTION OF THE PREFERRED EMBODIMENTS

Figure 1:
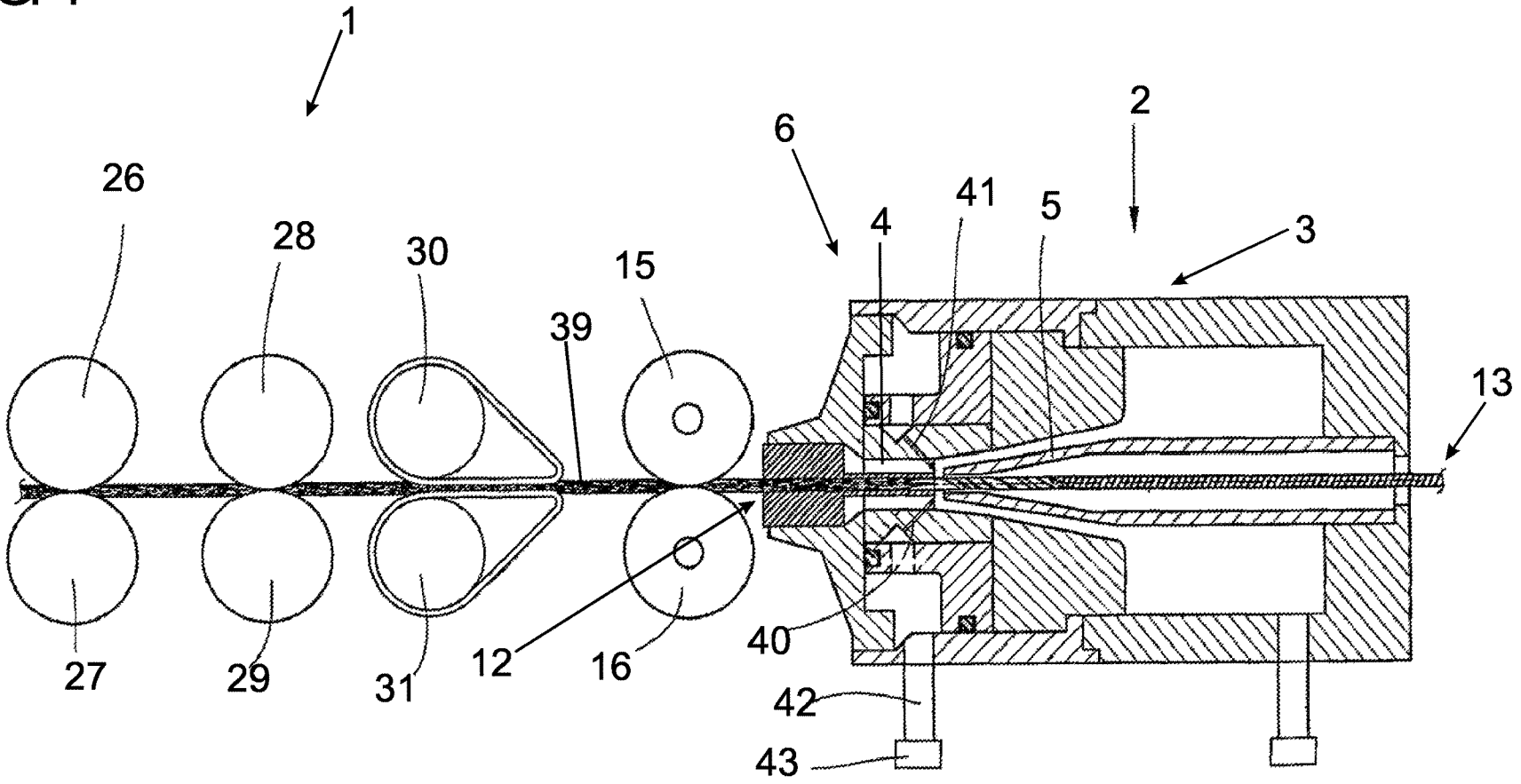
FIG. 1 shows a schematic representation of an air jet spinning device known from the prior art, with an upstream drafting system.

For a general understanding of the mode of function of an air jet spinning device 2, FIG. 1 shows the basic structure of a drafting system 1 with a downstream air jet spinning device 2. The sliver 39 taken up from a sliver source not shown here is pulled in by an input roller pair formed by an input top roller 26 and an input bottom roller 27. The sliver 39 is then drafted between the second drafting system top roller 28 and the second drafting system bottom roller 29 as well as the third drafting system top roller 30 and third drafting system bottom roller 31 and the subsequent output roller pair consisting of output top roller 15 and output bottom roller 16. The drafted sliver 39 then passes through an entry region 12 of a nozzle unit 6 into the air jet spinning device 2 and is transformed therein into a thread by means of a thread-forming unit 3 and the nozzle unit 6 of the air jet spinning device 2.

The nozzle unit 6 has nozzles 40, 41 for this purpose, which are connected to a compressed air source 43 via lines 42. The air flowing out of the nozzles 40, 41 produces a rotational flow, which is applied to the fed, drafted sliver 39. The thread-forming unit 3 has a thread-forming element in the form of a spinning cone 5, which, in conjunction with the nozzle unit 6, forms a thread, which is taken up from the air jet spinning device 2 via the hollow spinning cone 5 through an outlet opening 13.

Figure 2:
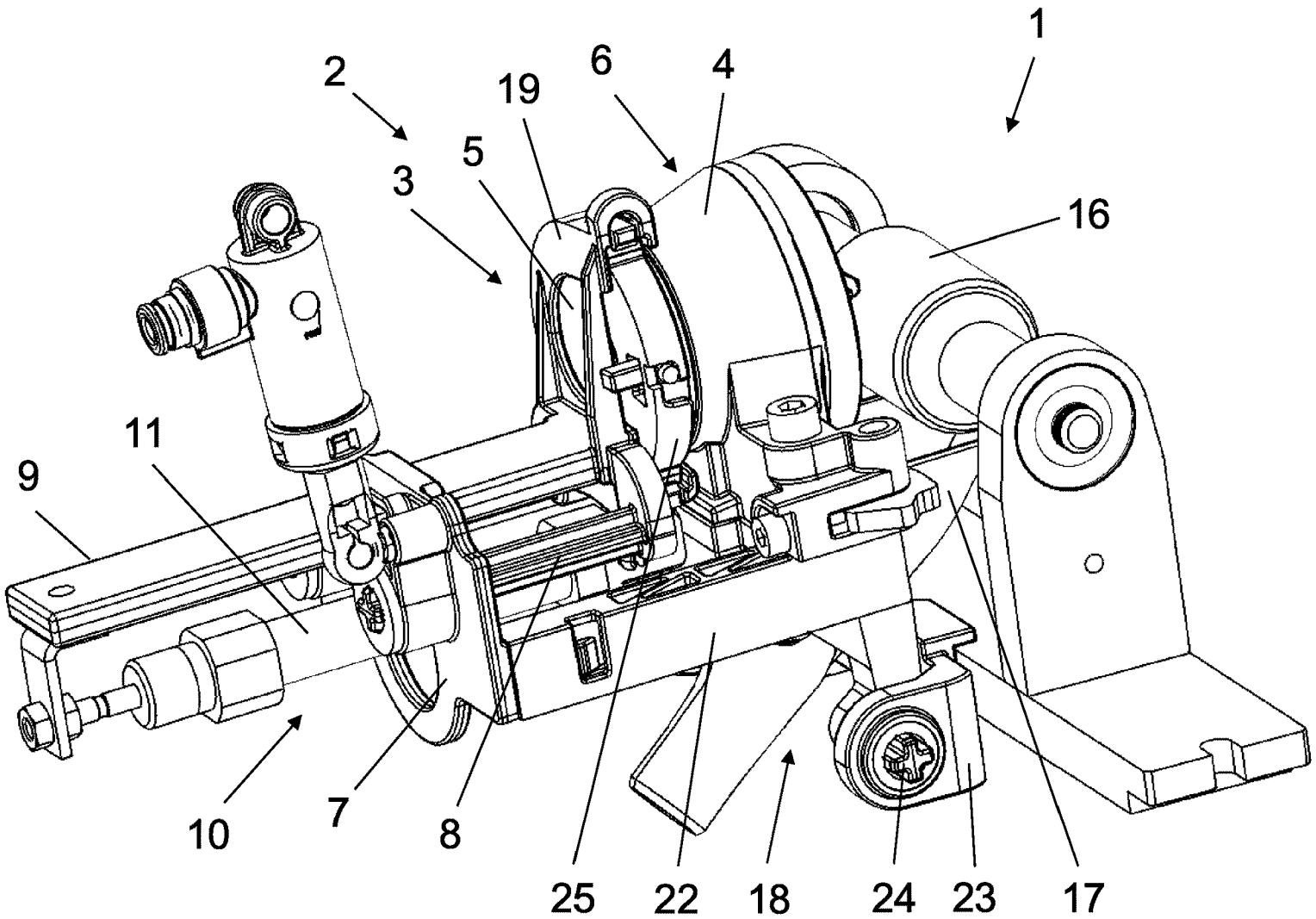
FIG. 2 shows a perspective representation of an air jet spinning device according to an embodiment example, which can be displaced and/or pivoted between an operating position and a cleaning position and then displaced and/or pivoted in relation to a drafting system.
Figure 3:
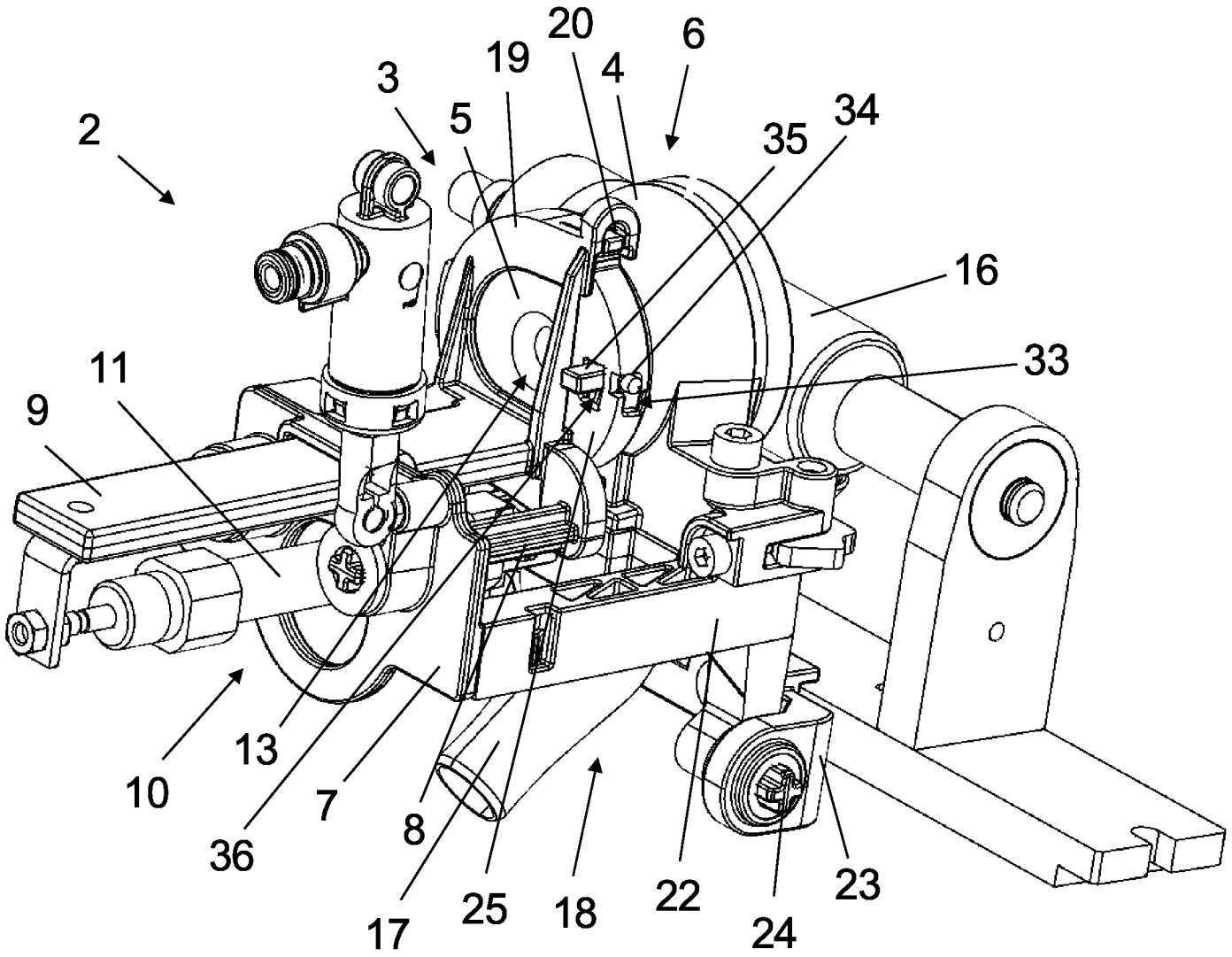
FIG. 3 shows a further perspective representation of the air jet spinning device in FIG. 2.

FIGS. 2 and 3 show an air jet spinning device 2 that can be repositioned between an operating position and a cleaning position, according to an embodiment example. The sliver 39 running in the region between the top rollers 15, 26, 28, 30 arranged on a weighting arm (not shown) and the bottom rollers 16, 27, 29, 31 arranged on a drafting system frame of the drafting system 1 is conveyed into the air jet spinning device 2 after having been drafted by the drafting system 1.

Figure 4:
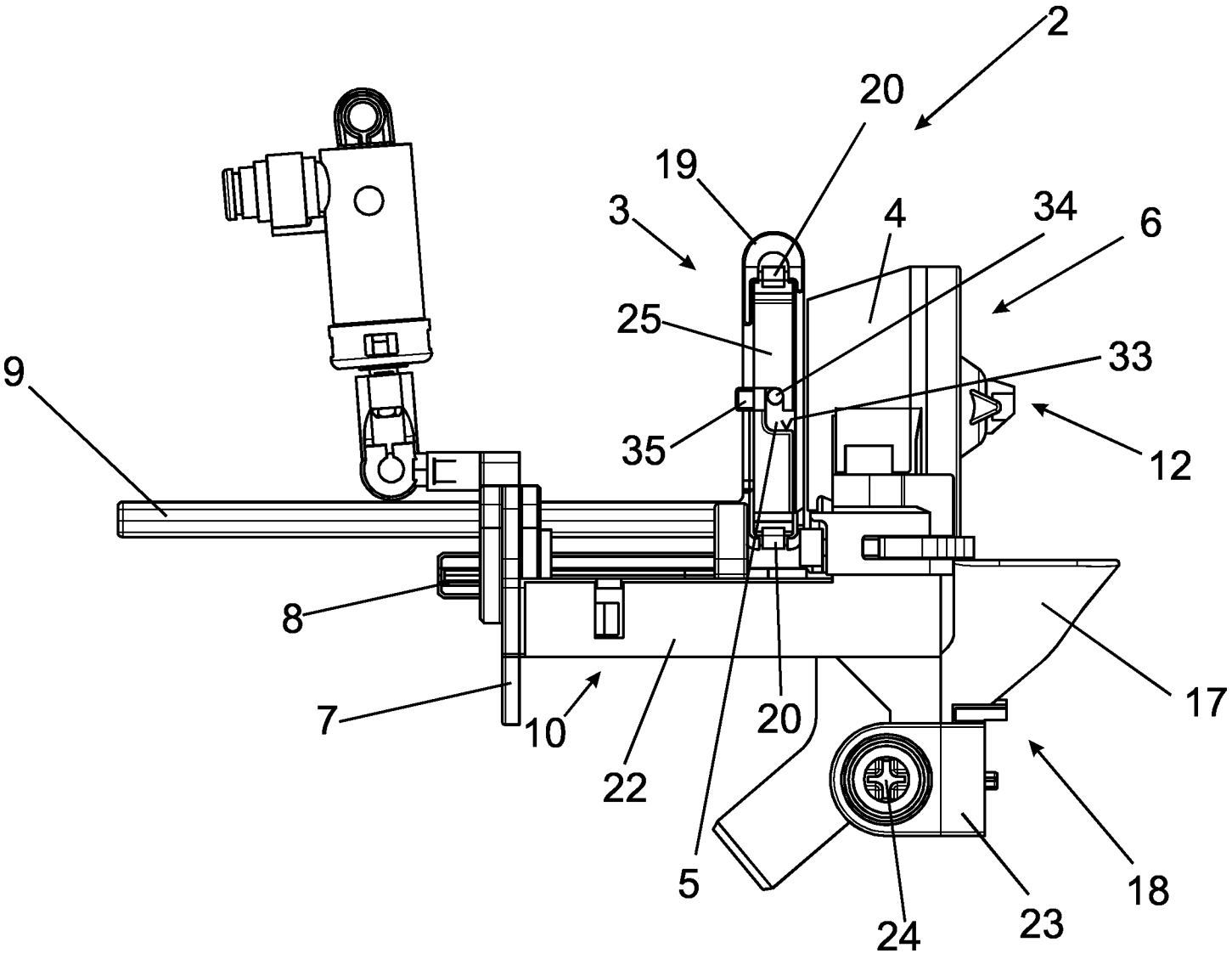
FIG. 4 shows a side view of the air jet spinning device in FIG. 2 in the operating position.
Figure 5:
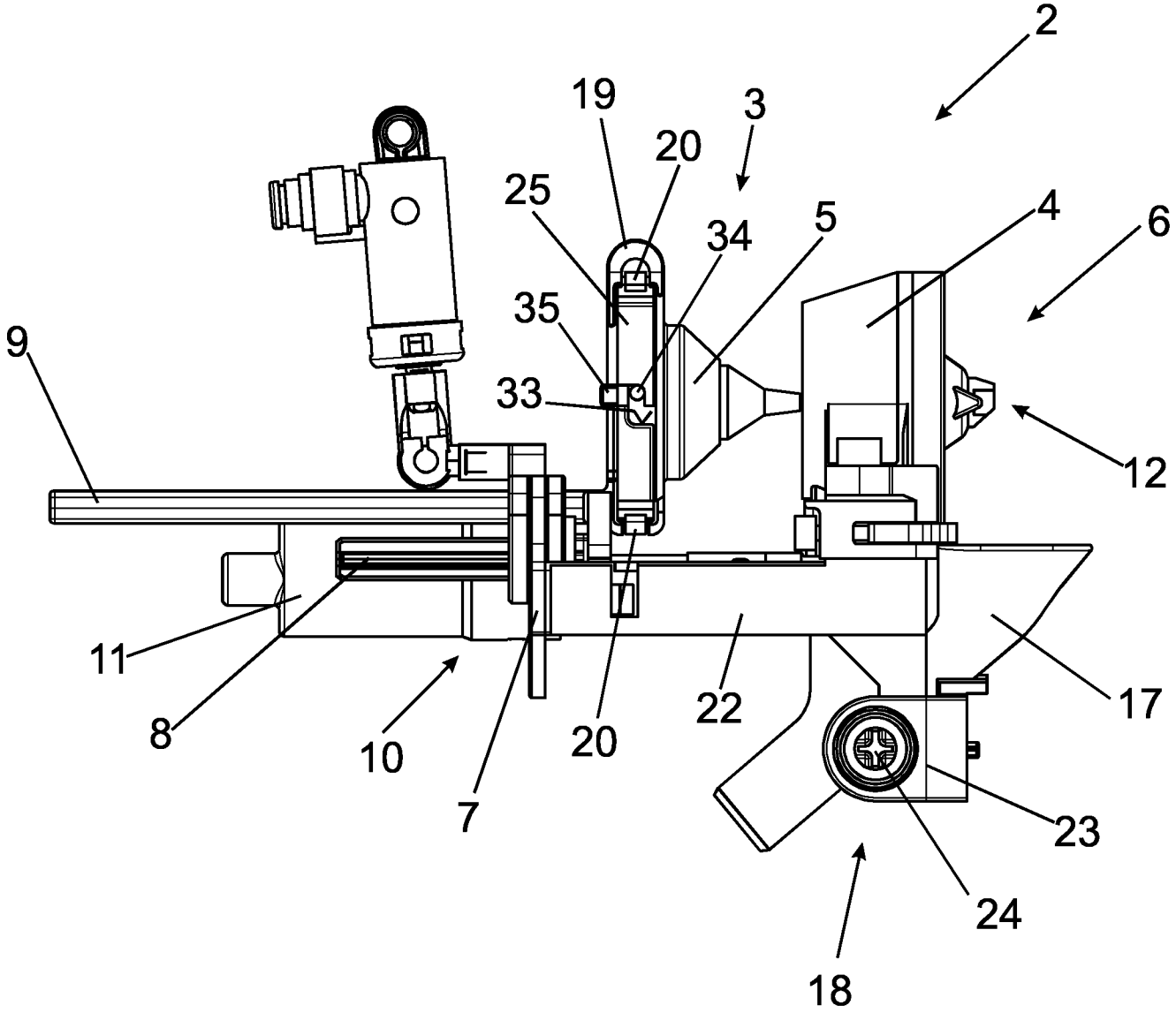
FIG. 5 shows a side view of the air jet spinning device in FIG. 2 in the cleaning position and FIG. 6 shows a perspective view of the air jet spinning device in FIG. 2 with a thread-forming element removed from an element carrier.
Figure 6:
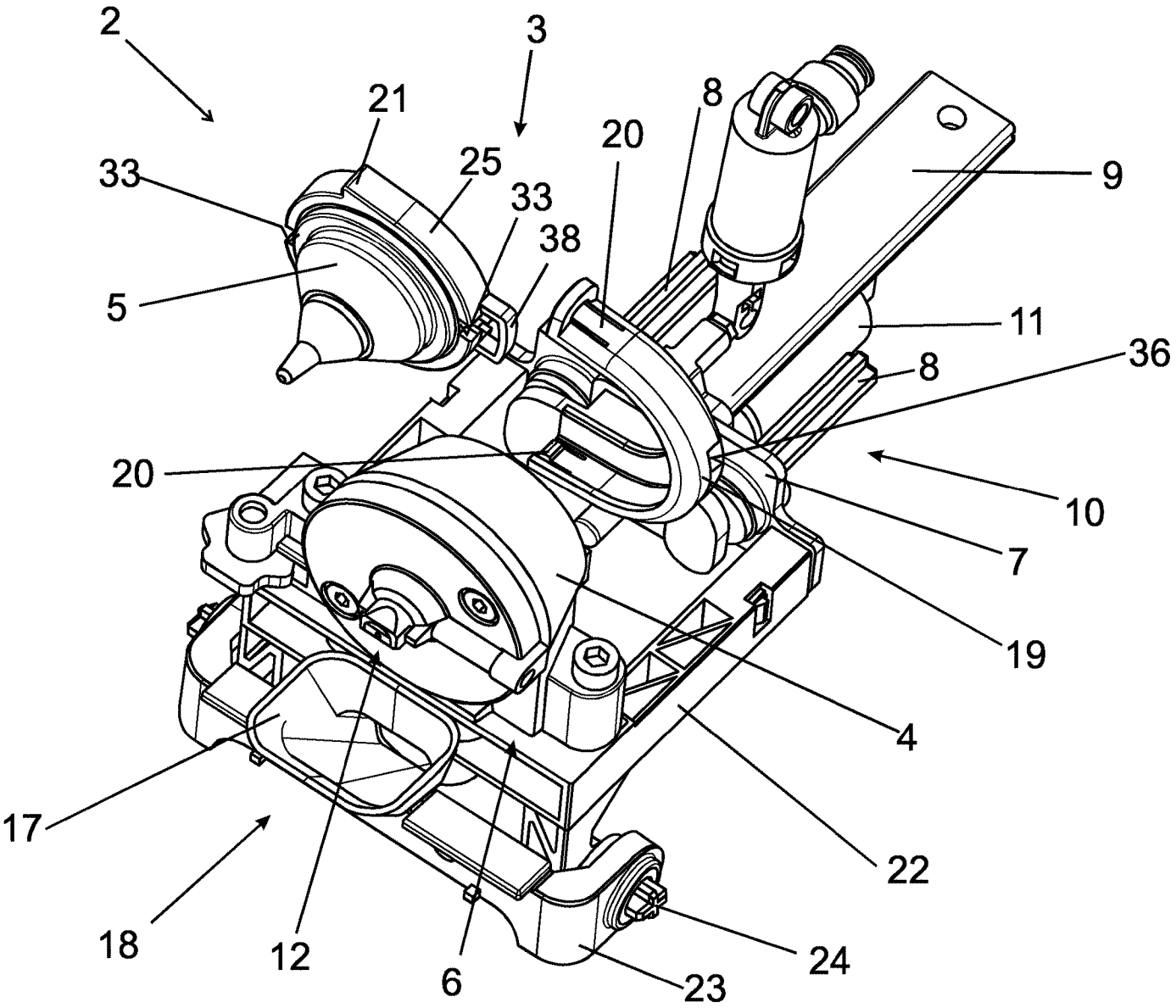

The air jet spinning device 2 has a nozzle unit 6 as well as a thread-forming unit 3, which can be repositioned relative to one another between an operating position shown in FIGS. 2, 3 and 4 and a cleaning position shown in FIGS. 5 and 6. In addition to the nozzles 40, 41 for generating a rotational flow acting on the drafted sliver 39, the thread-forming unit 3 also has a vortex chamber 4, within which, in the operating position, the thread-forming element in the form of the spinning cone 5 is arranged. Within the air jet spinning device 2, the drafted sliver 39 is transformed into a thread according to the operating principle shown in FIG. 1, which thread can be taken up through the outlet opening 13.

For repositioning the thread-forming unit 3 with the spinning cone 5 relative to the nozzle unit 6, the air jet spinning device 2 according to this embodiment example has a guide element 7 arranged on a base carrier 22 of the air jet spinning device 2. The guide element 7 has mounting openings for the displaceable mounting of guide rails 8 connected to the thread-forming unit 3 and of a guide element 9. A pneumatic drive unit 10 with a drive cylinder 11 is used to move the thread-forming unit 3 between the operating position and the cleaning position. A pressurisation of the drive cylinder 11 causes a displacement of the thread-forming unit 3 in the longitudinal axis direction of the guide rails 8 and the guide rod 9 relative to the base carrier 22 and the nozzle unit 6, which is arranged in a fixed position on the base carrier 22, into the cleaning position shown in FIGS. 5 and 6.

In the cleaning position, the air jet spinning device 2 is pivotably connected to the drafting system 1 by means of the articulated arrangement of the base carrier 22 on a retainer 23 arranged on the drafting system 1, the articulated connection being established by means of suitable bearing pins 24. In the cleaning position, the opened air jet spinning device 2 can be pivoted relative to the drafting system 1 in such a way that an extraction nozzle 17 of an extraction device 18, which is arranged in the entry region 12 of the nozzle unit 6, is arranged relative to the output bottom roller 16 in such a way that contamination can be extracted via the extraction nozzle 17 both from the entry region 12 of the nozzle unit 6 and from the region around the output bottom roller 16.

For easy replacement of the thread-forming element designed as a spinning cone 5, the air jet spinning device 2 has an element carrier 19 which is designed to detachably receive an element frame 25 which accommodates the spinning cone 5. Thus, the element frame 25 has an opening for receiving the spinning cone 5, which opening is provided with mounting openings 33 on the edge, which enable a bayonet-type reception of studs 34 arranged on the spinning cone 5, by means of which studs 34 the spinning cone 5 can thus be arranged in a fixed position on the element frame 25. A protrusion 35 projecting from a rear side of the spinning cone 5 extends, in the assembled position, through an opening 36 at the element frame 25 and allows the spinning cone 5 to be oriented in its circumferential direction.

The element frame 25, for its part, can be arranged in a fixed location on the element carrier 19. For this purpose, the element frame 25 has a bar element 38, which orients the element frame 25 in the circumferential direction with respect to the element carrier 19, as well as detent protrusions 21 for locking. In the assembled position of the element frame 25 on the element carrier 19, the bar element 38 extends through an opening 36 of the element carrier 19. In addition, the element frame 25 is locked in its position in the assembled position by means of elastic detent bodies 20, which engage with the detent marks 21 on the element frame 25. For removal of the element frame 25 with the spinning cone 5, the detent bodies 20 are moved against their elastic preload so that the element frame 25 can be removed laterally from the element carrier 19. The spinning cone 5, for its part, because of the bayonet-type connection with the element frame 25, can be moved by partial rotation into a position in which the spinning cone 5 can be removed from the element frame 25.

LIST OF REFERENCE SIGNS

1 Drafting system
2 Air jet spinning device
3 Thread-forming unit
4 Vortex chamber
5 Thread-forming element
6 Nozzle unit
7 Guide element
8 Guide rail
9 Guide rod
10 Drive unit
11 Drive cylinder
12 Entry region
13 Outlet opening
15 Output top roller
16 Output bottom roller
17 Extraction nozzle
18 Extraction device
19 Element carrier
20 Detent body
21 Detent protrusions
22 Base carrier
23 Retainer
24 Bearing pin
25 Element frame
26 Input top roller
27 Input bottom roller
28 2nd drafting system top roller
29 2nd drafting system bottom roller
30 3rd drafting system top roller
31 3rd drafting system bottom section
33 Mounting opening
34 Stud
35 Protrusion
36 Opening
37 Recess
38 Bar element
39 Sliver
40 Nozzle
41 Nozzle
42 Lines
43 Compressed air source

The invention claimed is:

1. An air jet spinning device for manufacturing an air-spun thread from a supplied sliver, the air jet spinning device comprising:

a thread-forming unit, which has a thread-forming element which can be or is arranged in a vortex chamber of a nozzle unit, and the nozzle unit, which has at least one air nozzle oriented toward the vortex chamber such that an air flow emerging from the air nozzle applies a rotational flow to the sliver, which can be or is fed into the vortex chamber, characterised in that the thread-forming unit is mounted so as to be linearly displaceable relative to the nozzle unit between a closed operating position and an open cleaning position of the air jet spinning device, and the air jet spinning device is linearly displaceable and/or pivotable in the cleaning position, and the thread-forming unit has an element carrier that releasably holds the thread-forming element in the cleaning position of the air jet spinning device and the element carrier is for lateral removal of the thread-forming element parallel to the drafting plane of the sliver.

2. The air jet spinning device according to claim 1, characterised in that a drafting system for feeding the sliver is associated with the air jet spinning device, the air jet spinning device being rotatably and/or pivotably supported on the drafting system for the purpose of the displacement and/or pivoting ability relative to the drafting system in the cleaning position.

3. The air jet spinning device according to claim 1, characterised by a drive unit for the automated displacement and/or pivoting of the air jet spinning device in the cleaning position.

4. The air jet spinning device according to claim 1, characterised in that the thread-forming unit is linearly displaced relative to the nozzle unit in the longitudinal axis direction of the thread-forming element.

5. The air jet spinning device according to claim 1, characterised in that the thread-forming unit is mounted on a guide element having a guide section, so as to be linearly displaceable relative to the nozzle unit.

6. The air jet spinning device according to claim 1, characterised by an associated drive unit for repositioning the air jet spinning device between the operating position and the cleaning position.

7. The air jet spinning device according to claim 6, characterised in that the associated drive unit is a pneumatically acting drive unit.

8. The air jet spinning device according to claim 1, characterised in that the element carrier has mounting openings for a bayonet-type locking of the thread-forming element and/or the locking of the thread-forming element by fastening clips.

9. The air jet spinning device according to claim 1, characterised by an extraction device arranged below the drafting plane of the sliver in an entry region of the nozzle unit.

10. A method for cleaning an air jet spinning device according to claim 1, characterised in that the thread-forming unit is linearly displaced relative to the nozzle unit in order to reposition the air jet spinning device from the closed operating position to the open cleaning position, and the opened air jet spinning device is then linearly displaced and/or pivoted.

11. The method according to claim 10, characterised in that the air jet spinning device is linearly displaced and/or pivoted, in the cleaning position, relative to the associated drafting system such that an extraction device arranged below the drafting plane in an entry region of the nozzle unit enters an operative connection with an output bottom roller of an output roller pair of the drafting system.

12. The method according to claim 10, characterised in that the opened air jet spinning device is then linearly displaced and/or pivoted relative to an associated drafting system.

13. A thread-forming unit for an air jet spinning device according to claim 1, characterised by an element carrier, which releasably holds a thread-forming element for arrangement in a vortex chamber of a nozzle unit, which nozzle unit can work in conjunction with the thread-forming unit.

14. The thread-forming unit according to claim 13, characterised in that the element carrier has mounting openings for a bayonet-type locking of the thread-forming element and/or the locking of the thread-forming element by fastening clips.

15. The thread-forming unit according to claim 13, characterised in that the element carrier is designed for the thread-forming element to be laterally received and removed obliquely to the thread forming direction of the thread-forming element.

* * * * *